United States Patent [19]

Schwartz

[11] Patent Number: 4,516,949

[45] Date of Patent: May 14, 1985

[54] SELF SEALING VALVE ASSEMBLY

[75] Inventor: Joel Schwartz, Brooklyn, N.Y.

[73] Assignee: U.S. Balloon Mfg. Co., Inc., Brooklyn, N.Y.

[21] Appl. No.: 350,307

[22] Filed: Feb. 19, 1982

[51] Int. Cl.[3] ..... A63H 3/06

[52] U.S. Cl. ..... 446/222; 53/403

[58] Field of Search ..... 46/87, 88, 90; 244/31, 244/33; 446/220, 222; 53/403

[56] References Cited

U.S. PATENT DOCUMENTS

| | | | |
|---|---|---|---|
| 3,088,242 | 5/1963 | Rockovits | 446/220 |
| 3,236,005 | 2/1966 | Tomosy et al. | 446/222 |
| 4,391,063 | 7/1983 | Gill | 446/222 |

*Primary Examiner*—F. Barry Shay

*Attorney, Agent, or Firm*—Lilling & Greenspan

[57] ABSTRACT

An inflatable assembly comprising a device having a body, with a neck terminating in a free end, with an opening extending from the free end and communicating with the body which is capable of being inflated. Closure means is provided and includes an adhesive element mounted on the neck and protruding or extending beyond the free end thereof, with the closure means adapted to be moved from an open position in which a tube extends into the neck such that a gas entering the device through the tube inflates the body to a closed position in which the adhesive element which extends beyond the free end is sealed when the tube is removed from the device. Guide means extends intermediate the tube and the adhesive element, and is adapted to be retracted from the closure means in conjunction with the tube such that the adhesive element when compressed is sealed together beyond the free end and the closure means is in its closed position so as to obtain a sealing of the neck to prevent gas from escaping therethrough.

19 Claims, 5 Drawing Figures

SELF SEALING VALVE ASSEMBLY

BACKGROUND OF THE INVENTION

The present invention is directed to an inflatable assembly, which includes a balloon or the like, and more particularly to a readily sealable valve or closure for use therewith.

Inflatable objects such as ballons or the like, having an inflatable body and a neck extending therefrom, suffer from the problem, that there is no economical way to quickly close the neck to prevent the gas from escaping. Balloons in various shapes and sizes are generally inflated with helium and sold at various amusement parks, sporting events, etc. These ballons in order to be quickly filled and economically priced for sale, have required a solution to the problem of sealing same prior to the gas escaping due the pressure differential. The tying of a string around the neck of the ballon, although widely used is time consuming and not as efficient as the present invention.

OBJECTS OF THE INVENTION

An object of the present invention is to provide an inflatable assembly with a closure or valve at one end thereof which is quickly and efficiently sealed.

Another object of the present invention is to provide a closure mounted on the neck of a balloons which is manually sealable so as to prevent the escape of gas from the balloons.

Another object of the invention is to provide a manner of quickly and efficiently closing or sealing of an inflated balloons so that people of various ages may use same.

Other objects and advantages of the present invention will become apparent as the disclosure proceeds.

SUMMARY OF THE INVENTION

An inflatable assembly comprising a device having a body with a neck terminating in a free end with an opening extending from the free end and communicating with the device which is capable of being inflated. Closure means is provided and includes an adhesive element mounted on the neck and extending beyond the free end thereof, with the closure means adapted to move from an open position in which a tube extends into the neck such that a gas entering the device through the tube inflates the body to a closed position in which the adhesive element extending beyond the free end is sealed when the tube is removed from the device.

Guide means extends intermediate the tube and the adhesive element, and is adapted to be retracted from the closure means in conjunction with the tube such that the adhesive element when compressed is sealed together beyond the free end and the closure means is in its closed position so as to obtain a sealing of the neck to prevent gas from escaping therethrough. The guide means has a surface thereon which does not adhere to the closure means so that it is readily retracted from its telescoping relationship with the closure means. The surface that is non-adhesive may include a silicone coating so as not to become adhered to the adhesive element.

The guide means includes a pair of elongated members adapted to extend in overlapping relation to each other with the tube therebetween and the members extending into the neck and the closure means. The elongated members may be fabricated from paper or other material with the silicone coating on the outer surface of each member which is in overlapping relationship to the adhesive of the adhesive element. The members each include a pair of spaced apart sides and spaced apart ends extending intermediate the sides to form a rectangular shape. The members are of substantially identical configuration.

The adhesive element of the closure means includes a pair of arms each one of the arms having an adhesive inner surface. The inner surface is fixedly secured to and extends partially over the neck and beyond the free end thereof. Each one of the arms includes a pair of spaced apart edges and spaced apart lips extending intermediate the edges. The arms have a width defined by the lips that is wider than the neck such that the portion of the arms adjacent to the lips are in sealed relationship to each other along the length thereof when the device is in its non-inflated position. The body may be in the form of a balloon adapted to be inflated by the inflow of gas through the tube.

The present invention also provides for a method of inflating and sealing a ballon or the like having a body with a neck extending therefrom. This is accomplished by mounting closure means on the neck having adhesive inner surfaces with a portion thereof that extends beyond the neck, and then inserting within the closure means a guide means so as to maintain the adhesive surfaces separated from each other as the balloon or the like is being inflated. By maintaining the tube within the guide means and filling the ballon or the like with a gas therethrough the body becomes inflated. Then by removing the tube and the guide means, and compressing the portions of the closure means extending beyond the neck, the adhesive surfaces are joined together to form a seal and retain the gas within the balloon or the like.

By connecting the tube to a supply of gas the balloon or the like is quickly inflated. The removing of the tube and the guide means includes gripping the closure means to retain the balloon or the like, and holding the guide means and the tube in relatively fixed position to each other, and separating the guide means and the tube away from the balloon or the like. By positioning the guide means such that one end extends into the neck proper positionment is assured and the tube is only in contact with the guide means.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 is a perspective view of an inflatable assembly illustrating the present invention and manner of using same;

FIG. 2 is an enlarged view of the closure of the present invention mounted on the balloon or the like;

DETAILED DESCRIPTION OF THE DRAWINGS

Figures 1, 2:
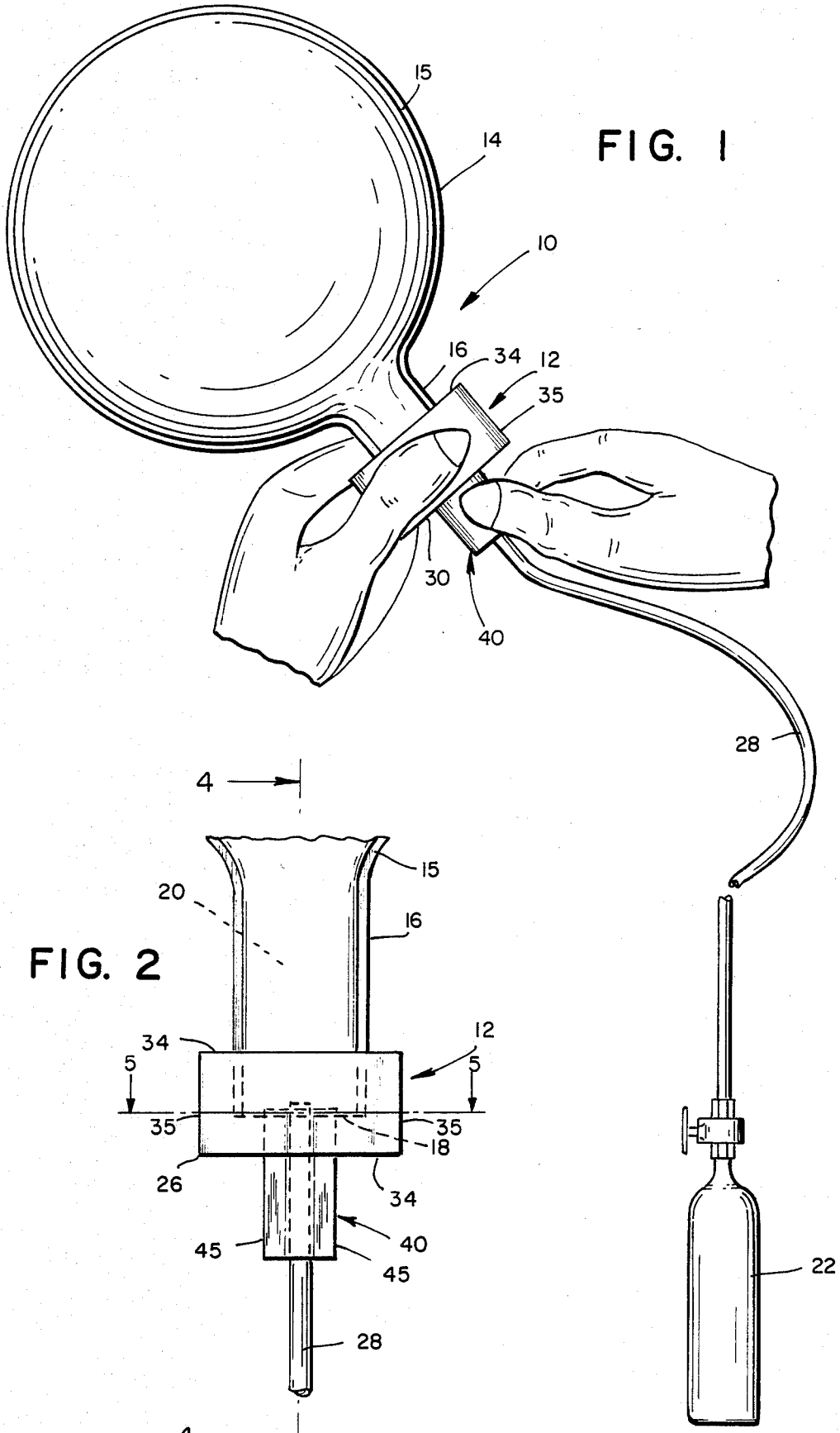

Referring to the drawings there is illustrated in FIGS. 1–5 an inflatable assembly 10 comprising a valve assembly 12 used with the device 14 having a body 15 with a neck 16 terminating in a free end 18. An opening 20 extends from the free end 18 and communicates with the device 14 which is capable of being inflated by a gas from a source 22. The source 22 may be helium or other gas or the body 15 may be inflated as a balloon by the mouth of a person.

Figure 4:
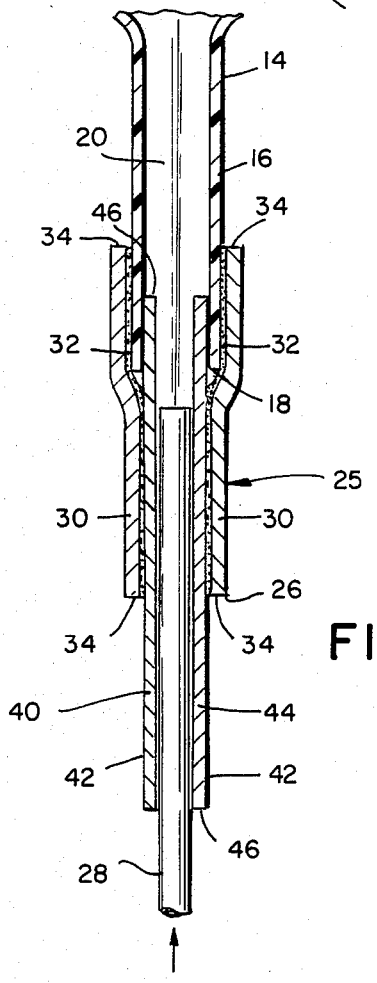
FIG. 4 is a sectional view taken along line 4—4 of FIG. 2.
Figure 5:
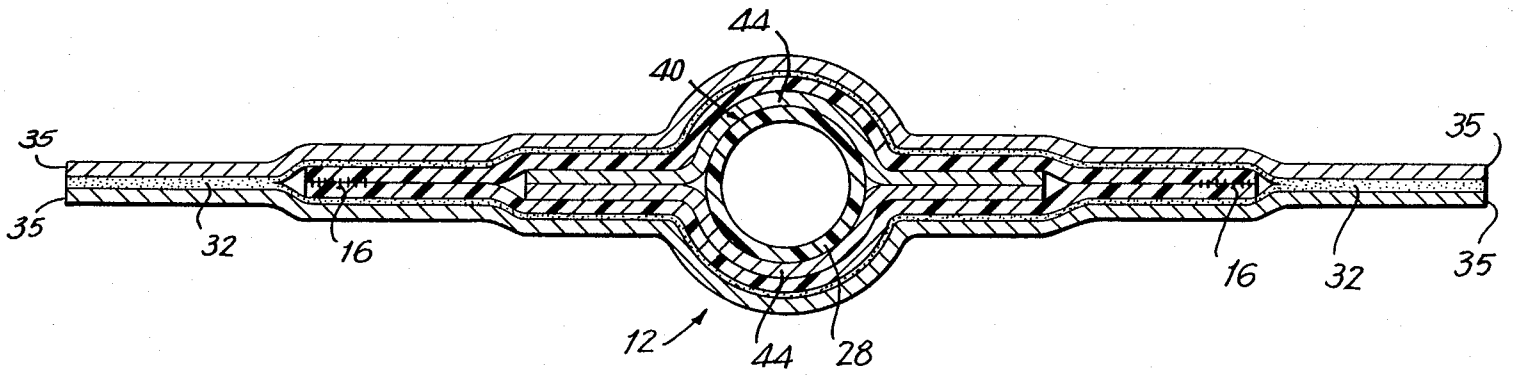
FIG. 5 is a sectional view taken along line 5—5 of FIG. 3 illustrating the sealed closure.

The valve assembly 12 includes closure means 25 comprised of an adhesive element 26 mounted on the neck 16 and extending beyond the free end 18 thereof. The closure means 25 is adapted to move from an open position as illustrated in FIG. 4, in which a tube 28 extends into the neck 16 such that a gas entering the device 14 through the tube 28 inflates the body 15 to a closed position as illustrated in FIG. 5, wherein the adhesive element 26 extends beyond the free end 18 and is sealed when the tube 28 is removed from the device 14 and is compressed.

The adhesive element 26 of the closure means 25 includes a pair of arms 30. Each one of the arms 30 having an adhesive inner surface 32. The inner surface 32 is fixedly secured to and extends partially over the neck 16 and beyond the free end 18 thereof. Each one of the arms 30 includes a pair of spaced apart edges 34 and spaced apart lips 35 extending intermediate the edges 34. The arms 30 have a width defined by the lips 35 that is wider than the neck 16 such that the portion of the arms 30 adjacent to the lips 35 are in sealed relationship to each other along the length thereof when the device 14 is in its non-inflated position. The body 15 may be in the form of a balloon adapted to be inflated by the inflow of gas through the tube 28.

Guide means 40 extends intermediate the tube 28 and the adhesive element 26, and is adapted to be retracted from the closure means 25 in conjunction with the tube 28 such that the adhesive element 26 when compressed is sealed together beyond the free end 18. At which time the closure means 25 is in its closed position so as to obtain a sealing of the neck 25 to prevent gas from escaping therethrough. The guide means 40 has a surface 42 thereon which does not adhere to the closure means 25 so that it is readily retracted from its telescoping relationship with the closure means 25. The surface 42 that is non-adhesive may include a silicone coating so as not to become adhered to the adhesive inner surface 32.

The guide means 40 includes a pair of elongated members 44 adapted to extend in overlapping relation to each other with the tube 28 therebetween and the members 44 extending into the neck 16 and the closure means 25. The elongated members 44 may be fabricated from paper or other material with the silicone coating on the outer surface 42 of each member 44 which is overlapping relationship to the adhesive 32 of the adhesive element 26. The members 44 each include a pair of spaced apart sides 45 and spaced apart ends 46 extending intermediate the sides 45 to form a rectangular shape. The members 44 are of substantially identical configuration.

Figure 3:
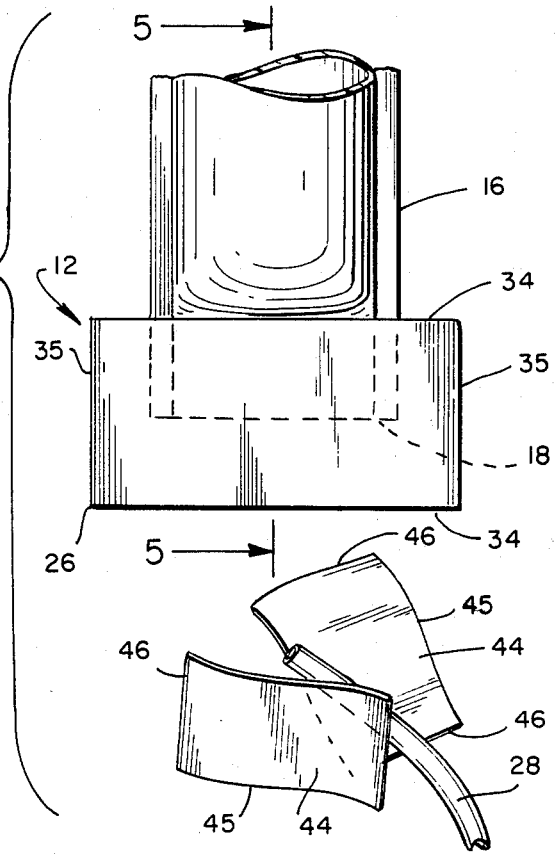
FIG. 3 is a fragmentary view illustrating the sealed closure upon the removal of the tube and guide means therefrom.

The present invention also provides for a method of inflating and sealing a balloon 14 by mounting the closure 25 on the neck 16 with the adhesive inner surfaces 32 partially extending beyond the free end 18. By then inserting within the closure means 25 the guide means 40 the adhesive surfaces 32 are separated from each other as the balloon 14 is being inflated. By maintaining the tube 26 within the guide means 40 and filling the ballon 14 with gas the body 15 becomes inflated. Then by removing the tube 28 and the guide means 40, as illustrated in FIG. 3, and compressing the portions of the closure means 40 extending beyond the neck 16, the adhesive surfaces 32 are joined together to form a seal, as illustrated in FIG. 5. The gas within the ballon 14 is then retained.

By connecting the tube 28 to the supply of gas 22 the ballon 14 is quickly inflated. The removing of the tube 28 and the guide means 40 includes gripping the closure means 25 with one hand as illustrated in FIG. 1, to retain the balloon 14 fixed, and holding the guide means 40 with the other hand as illustrated in FIG. 1, and then separating the guide means 40 and the tube 28 away from the ballon 14. By positioning the guide means 40 such that one end of each member 44 extends into the neck 16 proper positionment is assured and the tube 28 is only in contact with the guide means 40 between the members 44. Before any appreciable amount of gas can escape the fingers of a person compress the arms 30 until the adhesive layer or coating 32 are compressed and seal the valve assembly 12.

Although an illustrative embodiment of the invention has been described in detail herein with reference to the accompanying drawing, it is to be understood that the invention is not limited to the precise embodiment, and that various changes and modifications may be effected therein without departing from the scope or spirit of the invention, except in the appended claims.

I claim:

1. An inflatable assembly comprising:

A. A device having an inflatable body with a neck thereon, said neck terminating in a free end and having an opening extending from said free end and communicating with the interior of said body which is capable of being inflated;

B. a tube initially extending at least partially into said neck through said opening;

C. closure means including an adhesive element adhesively mounted externally on said neck and having a substantial, adhesive-coated area protruding beyond said free end, said closure means being adapted to be moved from an open condition in which said tube extends into said neck such that a gas entering said device through said tube inflates said body to a closed condition in which at least a portion of said coated area of said adhesive element which extends beyond said free end is sealed to another portion thereof when said tube is removed from said opening to seal said neck opening;

D. guide means extending intermediate a surface of said tube and a portion of said adhesive-coated area of said adhesive element, said guide means including surface means adapting it to be retracted from said closure means with the tube such that said adhesive element when compressed is sealed together beyond said free end and said closure means is in its closed condition so as to obtain a sealing of said neck to prevent gas from escaping therethrough.

2. An inflatable assembly as defined in claim 1, wherein said surface means of said guide means comprises a surface thereon which contacts the adhesive of said closure means but does not adhere to said closure means.

3. An inflatable assembly as defined in claim 2, wherein said surface includes a silicone coating.

4. An inflatable assembly as defined in claim 2, wherein said guide means includes a pair of elongated members adapted to extend in overlapping relation to each other with said tube therebetween and said members extending into said neck and said closure means.

5. An inflatable assembly as defined in claim 4, wherein said members each include a pair of spaced apart sides and spaced apart ends extending intermediate said sides.

6. An inflatable assembly as defined in claim 5, wherein said members are of substantially identical configuration.

7. An inflatable assembly as defined in claim 1, wherein said adhesive element of said closure means includes a pair of arms, each one of said arms having an adhesive inner surface, each said inner surface fixedly secured to and extending partially over said neck and beyond said free end thereof.

8. An inflatable assembly as defined in claim 7, wherein each one of said arms includes a pair of spaced apart edges and spaced apart lips extending intermediate said edges.

9. An inflatable assembly as defined in claim 8, wherein each one of said arms having a width defined by said lips that is wider than said neck such that the portion of said arms adjacent to said lips are in sealed relationship to each other along the length thereof.

10. An inflatable assembly as defined in claim 1, wherein said body is in the form of a balloon adapted to be inflated by the inflow of gas through said tube.

11. An valve assembly for use with an inflatable body having a neck terminating in a free end and having an opening extending from the free end which communicates with the body, said valve assembly comprising:

A. a tube initially extending at least partially into said neck through said opening;

B. closure means including an adhesive element adhesively mounted externally on said neck and having a substantial, adhesive-coated area protruding beyond said free end, said closure means being adapted to be moved from an open condition in which said tube extends into said neck such that a gas entering said device through said tube inflates said body to a closed condition in which at least a portion of said coated area of said adhesive element which extends beyond said free end is sealed to another portion thereof when said tube is removed from said opening to seal said neck opening;

C. guide means extending intermediate a surface of said tube and a portion of said adhesive-coated area of said adhesive element, said guide means including surface means adapting it to be retracted from said closure means with the tube such that said adhesive element when compressed is sealed together beyond said free end and said closure means is in its closed condition so as to obtain a sealing of said neck to prevent gas from escaping therethrough.

12. An assembly as defined in claim 11, wherein said surface means of said guide means comprises a surface thereon which does not adhere to said closure means.

13. An assembly as defined in claim 12, wherein said surface includes a silicone coating.

14. An assembly as defined in claim 12, wherein said guide means includes a pair of elongated members adapted to extend in overlapping relation to each other with said tube therebetween and said members extending into said neck and said closure means.

15. An assembly as defined in claim 14, wherein said members each include a pair of spaced apart sides and spaced apart ends extending intermediate said sides.

16. An assembly as defined in claim 15, wherein said members are of substantially identical configuration.

17. An assembly as defined in claim 11, wherein said adhesive element of said closure means includes a pair of arms, each one of said arms having an adhesive inner surface, each said inner surface fixedly secured to and extending partially over said neck and beyond said free end thereof.

18. An assembly as defined in claim 17, wherein each one of said arms includes a pair of spaced apart edges and spaced apart lips extending intermediate said edges.

19. An assembly as defined in claim 18, wherein each one of said arms have a width defined by said lips that is wider than said neck such that the portion of said arms adjacent to said lips are in sealed relationship to each other along the length thereof.

* * * * *